US006431607B1

(12) United States Patent
Kittelmann et al.

(10) Patent No.: US 6,431,607 B1
(45) Date of Patent: Aug. 13, 2002

(54) TELESCOPABLE VACUUM-CLEANER SUCTION PIPE

(75) Inventors: Gotthard Kittelmann, Eslohe-Wenholthausen; Olaf Günther, Sundern; Jürgen Schiemann, Ense-Höingen, all of (DE)

(73) Assignee: Froh House Tech GmbH & Co. KG, Sundern (DE)

( * ) Notice: Subject to any disclaimer, the term of this patent is extended or adjusted under 35 U.S.C. 154(b) by 0 days.

(21) Appl. No.: 09/578,600

(22) Filed: May 25, 2000

(30) Foreign Application Priority Data

May 28, 1999 (DE) ..... 199 24 450

(51) Int. Cl.[7] ..... F16L 35/00

(52) U.S. Cl. ..... 285/7; 285/303; 285/320; 285/921

(58) Field of Search ..... 285/7, 303, 320, 285/921

(56) References Cited

U.S. PATENT DOCUMENTS 5,332,266 A * 7/1994 Canale ..... 285/7
5,692,782 A * 12/1997 Fischer ..... 285/7
6,148,474 A * 11/2000 Ohara et al. ..... 285/7 X

FOREIGN PATENT DOCUMENTS

DE 297 19 437 3/1998

* cited by examiner

*Primary Examiner*—Neill Wilson
(74) *Attorney, Agent, or Firm*—Herbert Dubno

(57) ABSTRACT

A vacuum-cleaner pipe assembly can have inner and outer pipes telescopingly engaged with one another and on a sleeve surrounding the inner pipe, a locking body which engages in selected detents formed on the inner pipe. A rocker or rotatable eccentric in a housing on the sleeve surrounding the inner pipe bears directly against the locking body and is biased by a spring into the locking position.

10 Claims, 16 Drawing Sheets

TELESCOPABLE VACUUM-CLEANER SUCTION PIPE

FIELD OF THE INVENTION

Our present invention relates to a telescopable vacuum-cleaner suction pipe of the type in which an adjusting mechanism or actuator is provided to allow telescoping of an inner pipe into an outer pipe or an outer pipe over the inner pipe.

BACKGROUND OF THE INVENTION

In telescopable vacuum-cleaner pipe assemblies, the suction pipe can be formed from an outer pipe and an inner pipe. The latter can have an axially-extending detent strip provided with recesses or the like and formed with at least one stop or blocking surface at each detent position while the outer pipe or a housing connected therewith is provided with a locking body displaceable toward the axis of the telescopingly-connected pipes and which engages in a selected one of the recesses to abut the stop surface thereof. The actuating device can move the locking body and a spring can be provided for maintaining the locked position.

The vacuum-cleaner suction pipe assembly of this type is disclosed in DE GM 297 19 437.2. The locking body of this system has a locking pin engageable in a detent hole of the inner pipe. Since these holes are pressed into the wall of the inner pipe, the lateral flanks of the detent holes tend to be inclined rather than perpendicular to the axis of the pipe and thus, when significant axial stress is applied between the inner and outer pipes, a camming action because of the inclination can give rise to a radial force component which can move the locking body out of the detent and release the lock.

OBJECTS OF THE INVENTION

It is, therefore, the principal object of the present invention to provide a telescopable vacuum-cleaner suction pipe assembly which has less of a tendency to self-release when axial stress is applied between inner and outer pipes.

Another object of the invention is to provide an assembly which is free from the drawbacks of the earlier system described and which, especially, provides a more reliable and is secure locking of the two pipes or tubes relative to one another.

It is also an object of the invention to provide a suction pipe assembly of the telescoping type whereby drawbacks of earlier systems are obviated.

SUMMARY OF THE INVENTION

These objects and others which will become apparent hereinafter are attained, in accordance with the invention by the use of an actuator which acts directly upon the locking body and is rotatable, i.e. pivotable or provided with an axis of rotation as in the case of an eccentric, and whereby the direct contact between the actuator and the locking body prevents the locking body from being cammed out of the detent recess, even when significant force is provided between the inner and outer pipes. More particularly, the surface which contacts the locking body of the actuator can be in line with the locking body and the axis about which the actuator can pivot or rotate so that the radial force, should it be produced, is entirely absorbed by the pivot or bearing of the rotatable body.

More particularly, the telescopable vacuum-cleaner suction pipe assembly can comprise:

- an outer pipe;
- an inner pipe telescopingly received in the outer pipe and provided with an axially extending row of detent recesses; and
- an adjusting mechanism on the outer pipe having:
  - a sleeve surrounding the inner pipe,
  - a housing on the sleeve opening toward the row,
  - a locking body in the housing displaceable into and out of engagement with a selected one of the detent recesses,
  - an actuator rotatably mounted in the housing and bearing directly upon the body for locking the body in the selected one of the recesses in a locking position of the actuator and enabling movement of the body out of the selected one of the recesses in an unlocked position of the actuator, and
  - a spring acting upon the actuator and biasing the actuator into the locking position.

As a consequence, even upon the development of high axial forces and the possible application of substantial outward radial force to the locking body in the locked position, the latter position will be maintained since there is no force which will tend to rotate the actuator. With the system of the invention, there is no spring or the like between the rotatable actuator and the locking body and thus the locking body is mechanically fixed in its locked position without any yieldability until the rotatable actuator is displaced. The spring acting on the rotatable member merely serves to bias the latter into the locking position and does not itself absorb any of the locking force or yield to any radial force which can result from the application of large axial forces to the inner and outer pipes.

In one embodiment of the invention, the rotatable body or actuator is an actuating or locking rocker which can have a pair of axial projections forming slide bodies receivable in kidney-shaped openings in opposite walls of the housing. In that case, the projections not only slide in the openings but allow rotation of the rocker on the housing. A securely locked position is ensured by providing the engaging surfaces of the rocker and the locking body or member so that they are perpendicular to the radial force which may be generated and in line with a position of the slide block or projection which prevents the rocker from slipping out of the locked position. The rocker and locking body can then be clamped with a certain force in the locked position. Because the rocker can slide along the kidney-shaped openings, only a slight actuating pressure by the finger is required on the rocker to displace it into the unlocked position.

The force which must be applied for unlocking and relocking the assembly is relatively small, especially when the rocker is provided with a rounded actuating surface which can engage an inclined surface of the locking body.

According to another feature of the invention, the locking body itself may be pivotal on the sleeve and indeed the locking body can be formed as a pawl or lever in one piece with the sleeve and indeed the locking body can be relatively small, having a thickness of only several millimeters and can have a fixed position on the sleeve.

In another aspect of the invention, the actuator can be a rocker with a fixed axis about which the rocker can pivot.

In still another aspect of the invention, the actuator can be a rotatable eccentric which has the advantage that the position of the eccentric can be fixed with great precision within the housing and can, upon rotation, provide a free space into which the locking body can move upon displacement of the actuator from its locking position into the unlocked position.

BRIEF DESCRIPTION OF THE DRAWING

The above and other objects, features, and advantages will become more readily apparent from the following description, reference being made to the accompanying drawing in which:

FIG. 31 is a side elevational view of a further adjusting device for a telescoping pipe assembly for a vacuum cleaner or the like;

SPECIFIC DESCRIPTION

Figure 1:
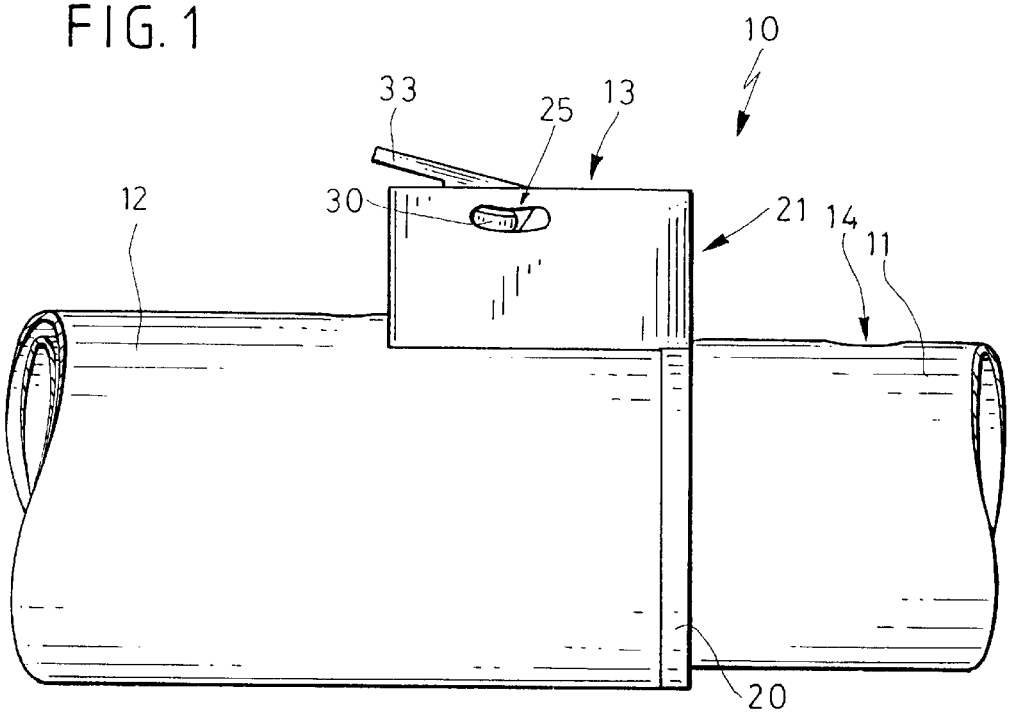
FIG. 1 is a side elevational view of a telescoping vacuum pipe provided with an adjusting device shown in the unlocked position according to the invention.

Throughout the drawing the telescoping suction pipe, including the adjustment or locking mechanism for locking the two telescopingly interconnected pipe members together has been represented at 10.

As has been shown in FIGS. 1–4, for example, the telescopic assembly 10 can comprise an inner pipe 11, an outer pipe 12 and an adjustment and locking mechanism 13. The inner pipe 11 can be provided with a detent strip 15 formed with detent recesses 14. The recesses 14 can have opposing flanks 16 which are referred to as locking flanks here and cooperate with the locking flanks 17 of a locking body 18. The latter can be moved into and out of the recesses 14 in a direction perpendicular to the axis x of the assembly of telescoping pipes.

The adjustment mechanism 13 comprises a sleeve 20 affixed on the outer tube 12 and extending into the annular space 19 between the inner and outer tubes 12 and 11 and which is formed with a housing 21.

Figure 15:
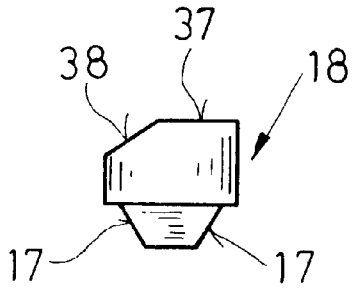
FIGS. 15 and 16 are respective elevational and perspective views of the locking body for the mechanism of FIGS. 1–4.
Figure 16:
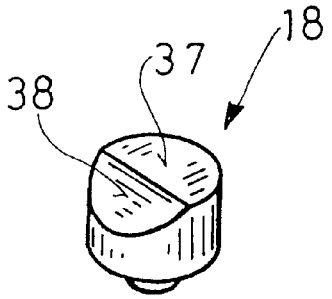
Figure 17:
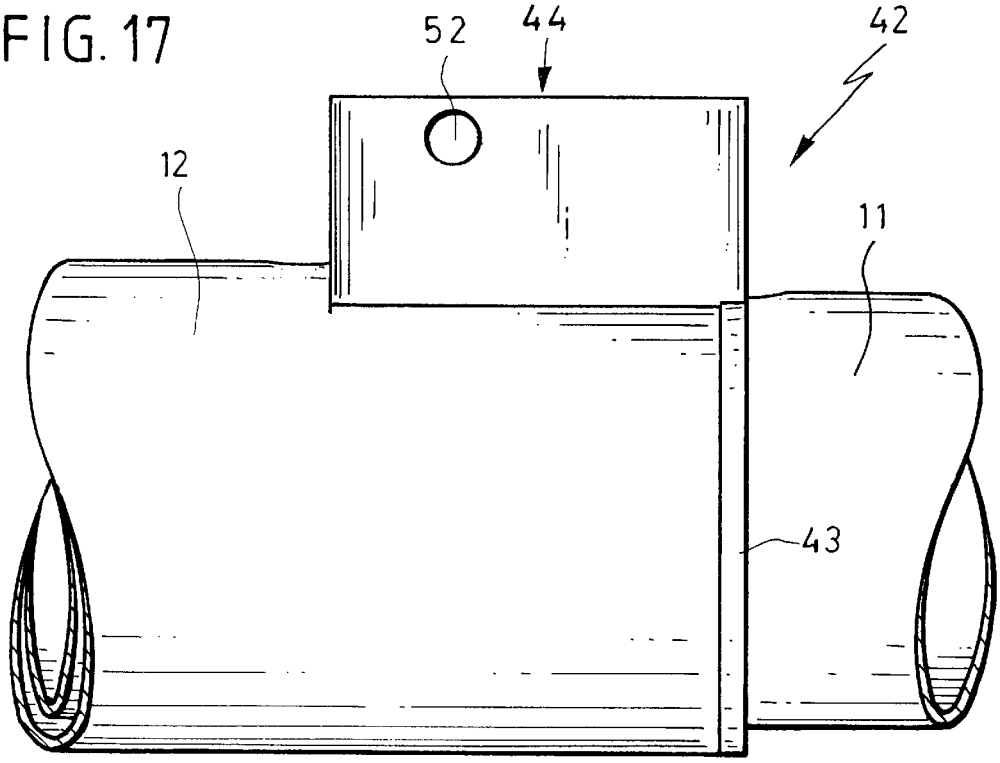
FIG. 17 is a side elevational view of a further suction pipe assembly of the telescoping type, showing the mechanism in its locked position.

The housing 21 is intended to receive the locking body 18 (see FIGS. 15 and 16), in addition to an actuating or locking rocker or lever 22 and its rocker spring 23.

The side walls 24 extending parallel to the longitudinal axis x of the pipes 11 and 12 and which are formed on the housing 21 have kidney-shaped openings 25 opposite one another (see especially FIGS. 10–14) within which the slide blocks of the rocker 22 are received. Below the openings 25 respective bearing shells 26 are formed along inner sides of the side walls 24. In the bottom 27 of the housing a circular opening 28 is provided within which the locking body 18 is received. A projection 29 is provided at one side of this opening in which the locking body 18 can be received in the unlocked position.

Figure 2:
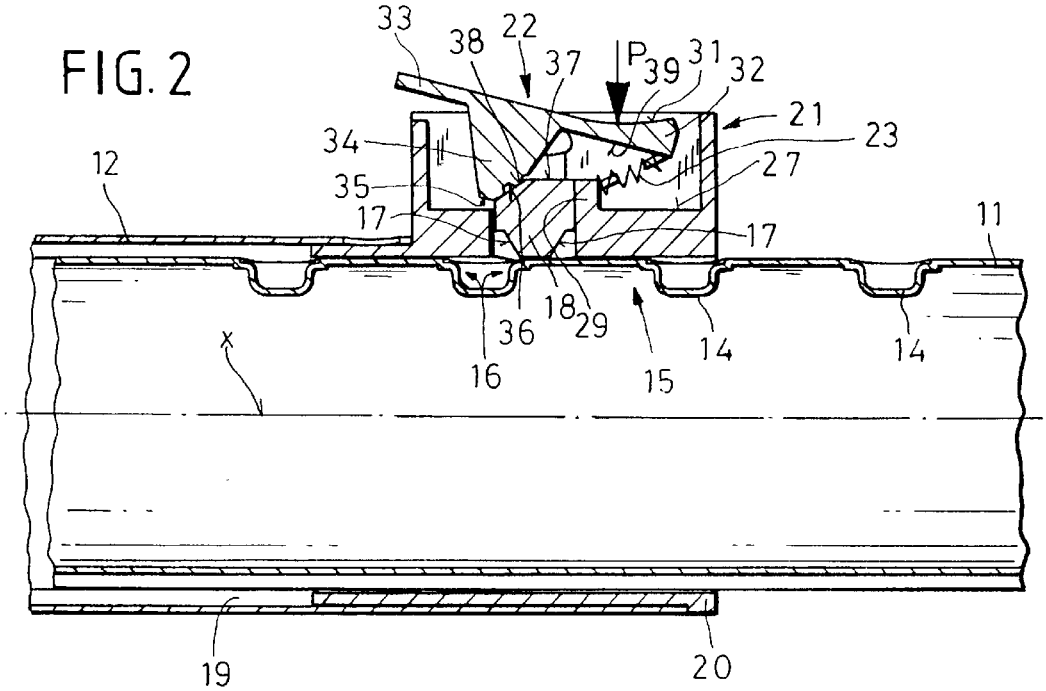
FIG. 2 is a longitudinal section through the device of FIG. 1, also in th unlocked state.
Figure 3:
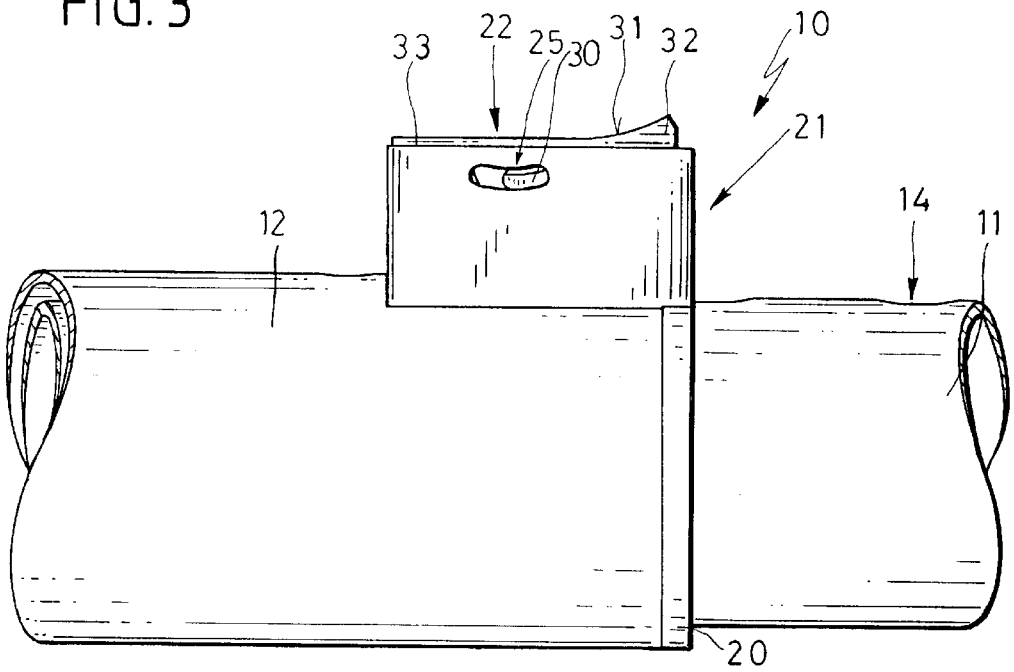
FIG. 3 is a side elevational view of the assembly of FIG. 1 in the locked state.

FIGS. 5–9 show the actuating rocker 22 in greater detail. On the opposite sides of this rocker, lateral projections 30 extend to form slide blocks which are received in the kidney-shaped recesses 25. The rocker 22 has a rocker arm 32 shaped at 31 for engagement by a finger of the user and a rocker arm 33 which only serves as a covering function for the mechanism within the housing 21 (see FIG. 4). Below the axial projections 30, an actuating projection 34 is formed which bears upon the locking body 18 and has a surface 35 which acts as a locking surface. The lateral surface 35 of the rocker affords the function of a slide or canning surface. From FIG. 4 one can see that the locking surface 35, in its locked state, lies flat against a juxtaposed end face 37 of the locking body 18. FIG. 2, which shows the unlocked state, makes clear that the surface 36 rests in point or line contact with the inclined camming surface 38 of the body 18. From these Figures moreover, it will be apparent that the limited contact between the surface 36 and the inclined plane surface 38 reduces the friction between the two and facilitates the displacement of the body 18 between the locked position (FIG. 4) and the unlocked position (FIG. 2).

Figure 4:
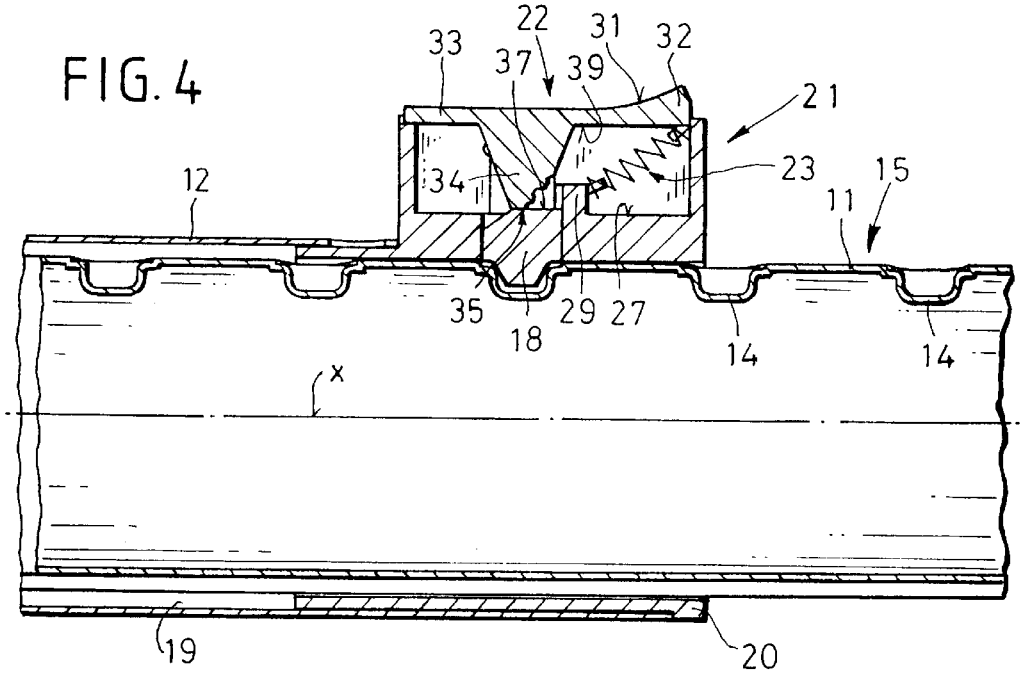
FIG. 4 is a longitudinal section through that assembly also shown in the locked state.
Figure 5:
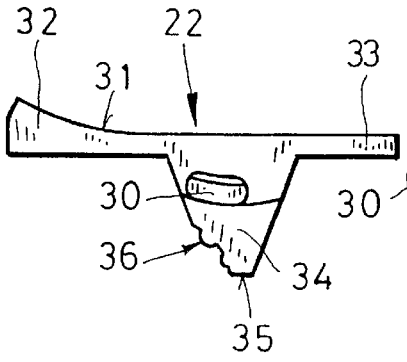
FIGS. 5–9 are views in elevation, plan and perspective showing details of the actuating lever for the rocker.
Figure 6:
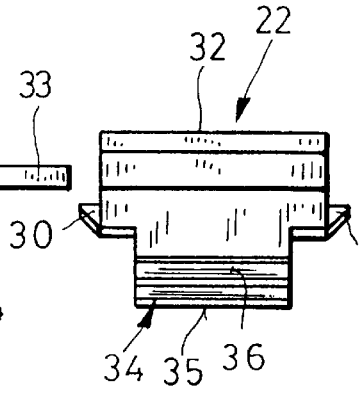
Figure 7:
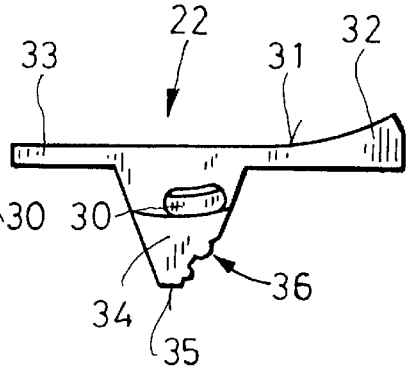
Figure 8:
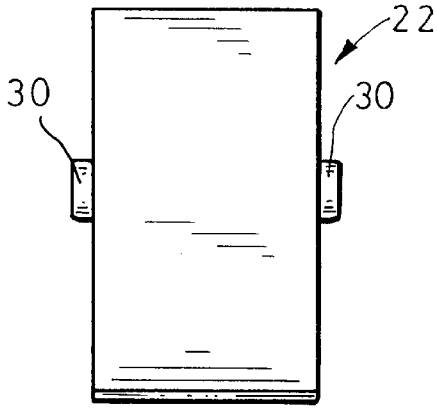
Figure 9:
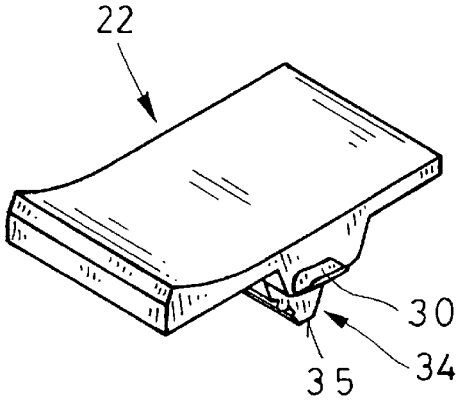
Figure 10:
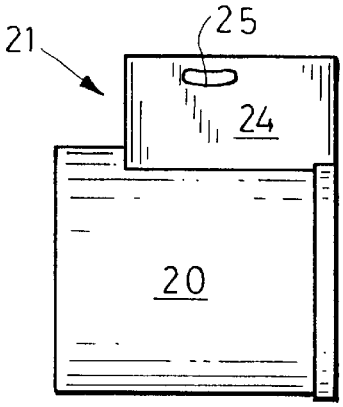
FIGS. 10–14 are various elevational and plan view of the sleeve and the rocker housing.
Figure 11:
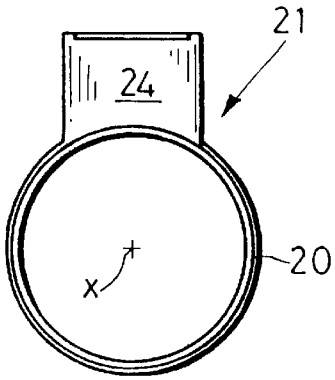
Figure 12:
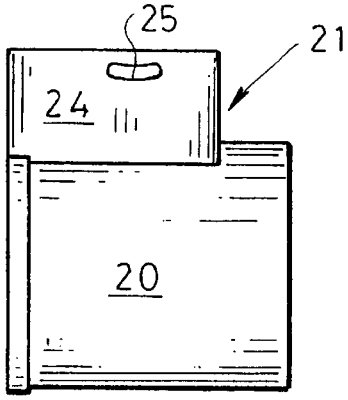
Figure 13:
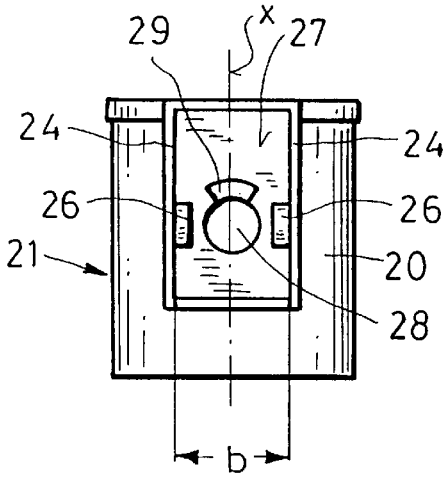
Figure 14:
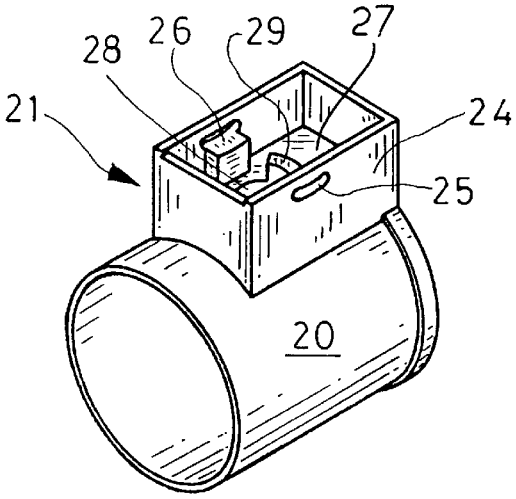
Figure 36:
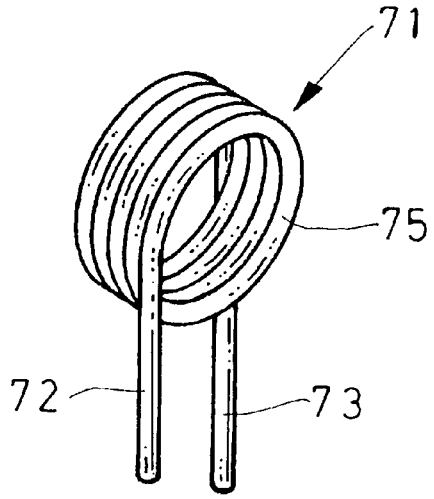
FIG. 36 is a perspective view of a torsion spring having shanks and suitable for use in the latter assembly.

From FIGS. 2 and 4, moreover, it can be seen that the rocker 22 is provided with a rocker spring 23 braced between the projection 29 and the housing 21 and a pin formed on the underside 39 of the rocker arm 32.

The mounting of the mechanism 13 is effected after the inner pipe 11 has been inserted by initially fitting the locking body 18 in the opening 28 of the housing. The rocker 22 is then inserted into the housing 21 from above and because of a certain overdimensioning of the rocker 22 in the region of the projections 30 with respect to the internal width b of the housing, the side walls 24 are slightly bent outwardly until the projections 30 engage in the openings 25. The mounting of the spring 23 on the pins of the projection 29 and the surface 39 is effected at the same time.

As soon as the rocker 22 is engaged between the walls 24, the mechanism is ready to lock the pipes 11 and 12 together.

FIG. 4 shows the locked position in which the locking body 18 has been pressed by the locking surface 35 to the rocker 22 against the surface 37 so that the body 18 is held against movement in one of the detent recesses 14. Even with the occurrence of substantial axial forces, the body 18 cannot be cammed outwardly since the radial force thereby applied to member 18 cannot displace the rocker 22. By application of a force P to the arm 32, however, the rocker can swing in a combined pivotal and sliding movement into the position shown in FIG. 2 and thereby permit the member 18 to slide with its inclined surface 38 on the surface 36 and move out of the recess 14. In spite of the relatively small displacement of the rocker 32, therefore, a relatively large movement of the actuating projection 34 and the locking surface 35 and the slide surface 36 is thereby obtained. To the extent that axial forces are generated by relative telescoping movement of the two pipes, the body 18 can yield to permit the inner pipe 11 to be thrust further into the pipe 12 or pulled therefrom.

As soon as the force P is removed from the rocker arm 32, the spring 23 displaces the rocker arm 22 automatically into the locked position as shown in FIG. 4.

In FIGS. 17–30, another adjustment device 42 is provided for the removal of the inner pipe 11 and the outer pipe 12. This adjustment device 44 comprises a sleeve 43 and a housing 44 formed thereon. The housing 44 has an opening 45 in its bottom which can accommodate a pawl 48 in the form of a swingable arm having a locking body 49 engageable in one of the recesses 14.

The housing 44 is also provided with openings 47 for a pivot pin or axle for the rocker 51.

Figure 18:
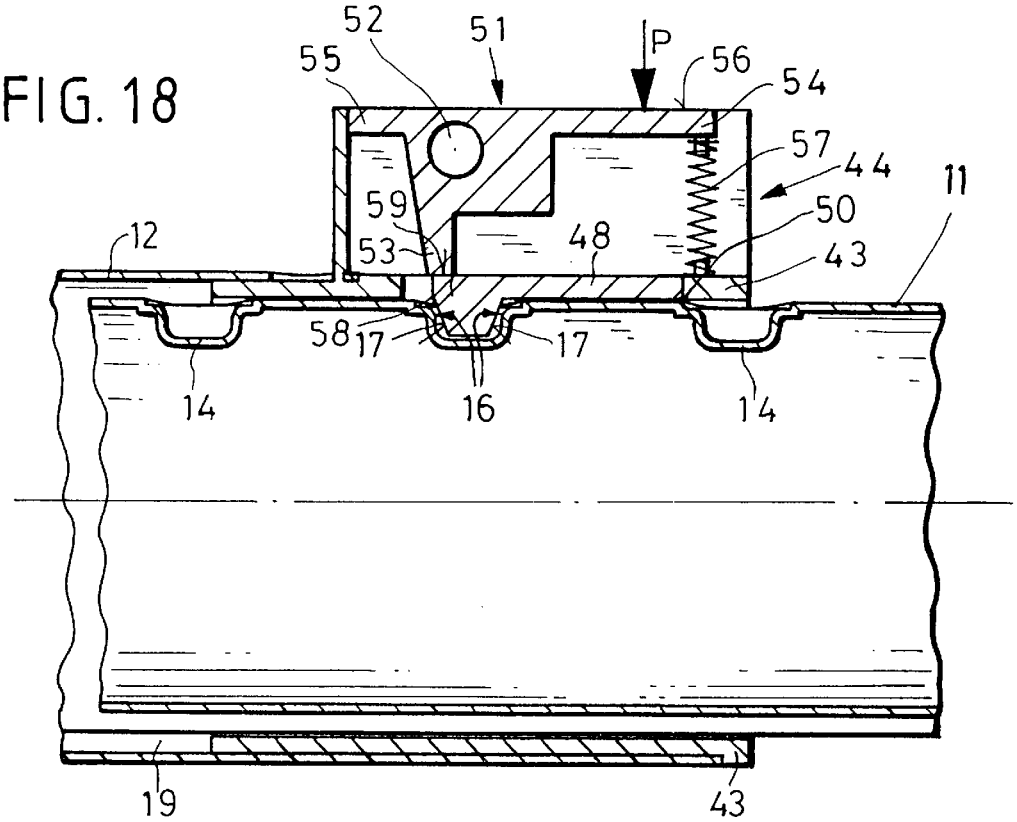
FIG. 18 is a longitudinal section through the assembly of FIG. 17 also in its locked position.
Figure 19:
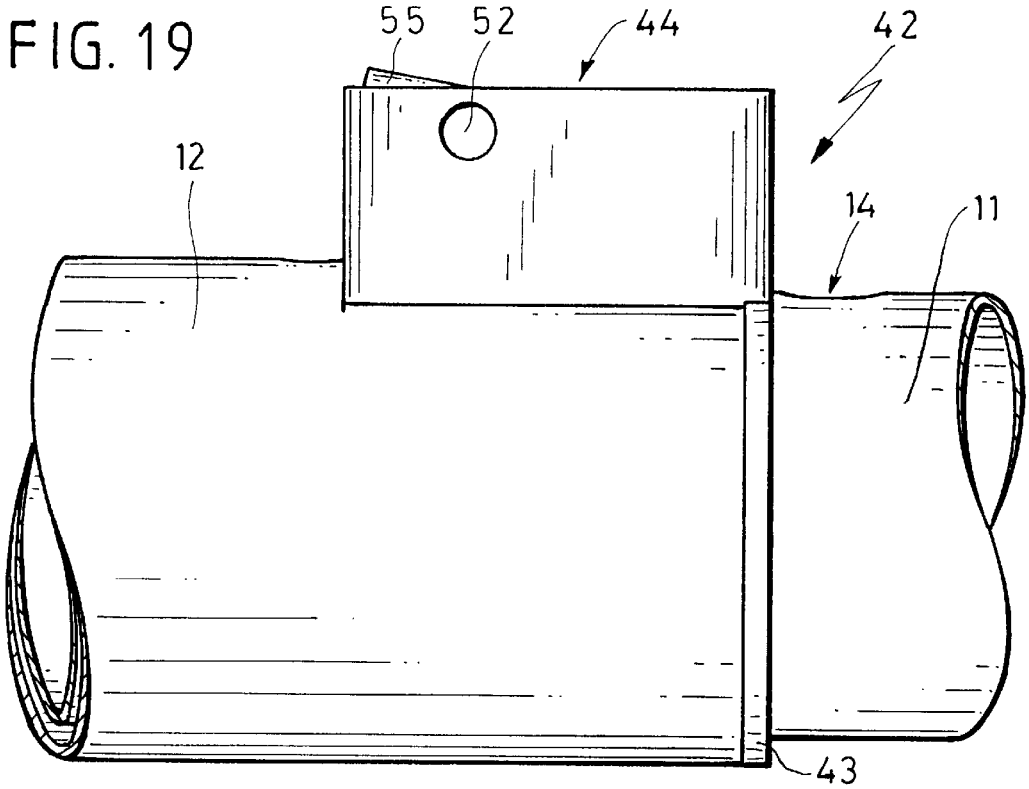
FIG. 19 is a side elevational view of the assembly of FIG. 17 in its unlocked position.
Figure 20:
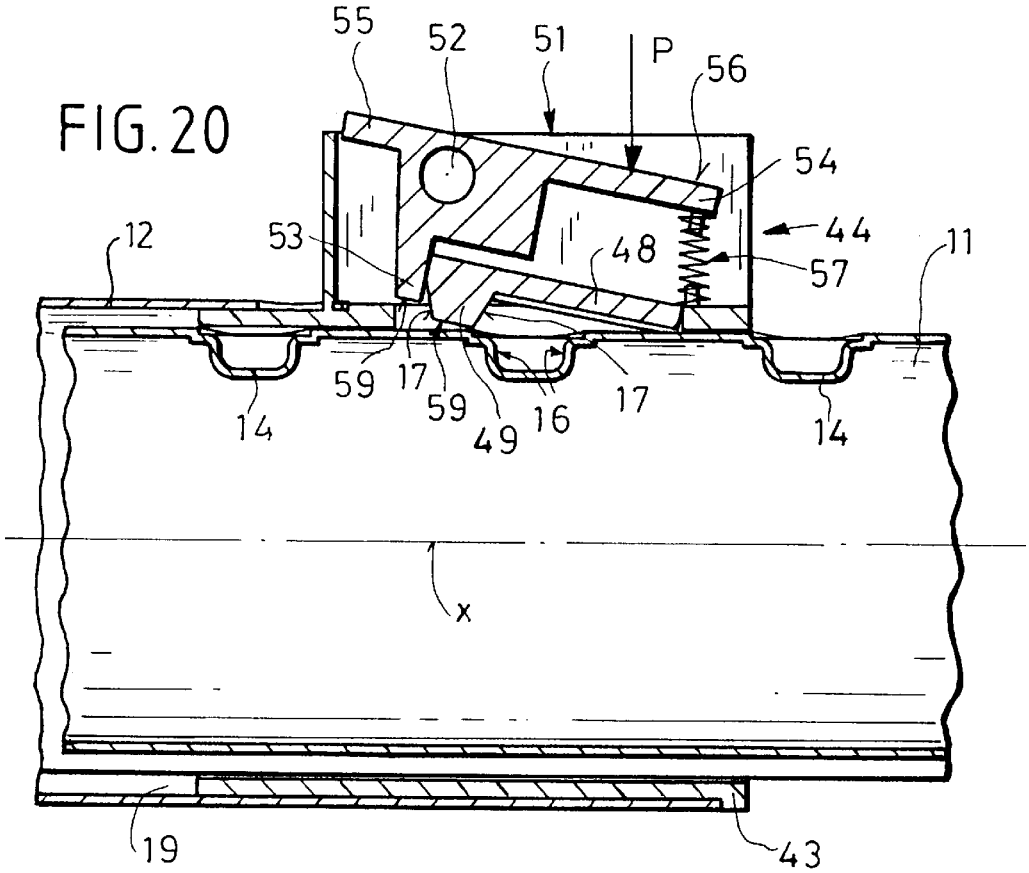
FIG. 20 is a longitudinal section through the telescoping pipe assembly of FIGS. 17–19 in the unlocked position thereof.
Figure 21:
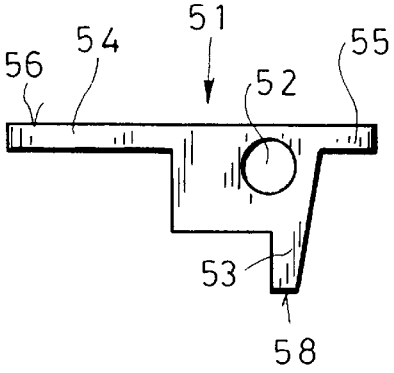
FIGS. 21–25 are various elevational, plan and perspective views of the rocker for the assembly of FIGS. 17–20.
Figure 22:
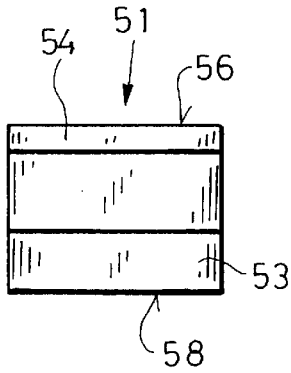
Figure 23:
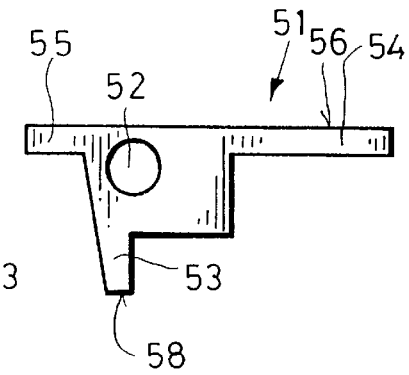
Figure 24:
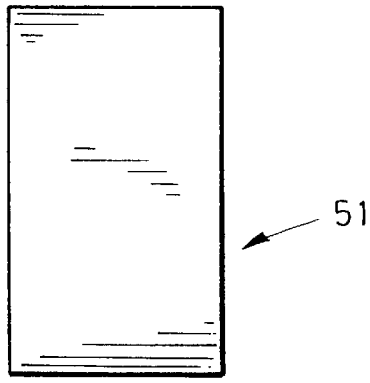
Figure 25:
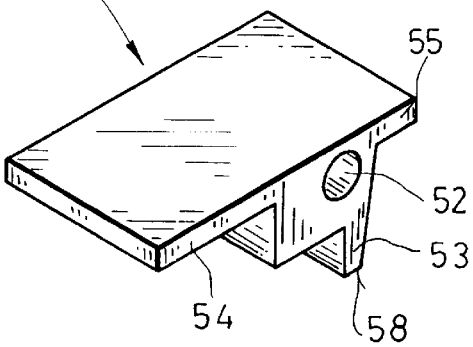
Figure 26:
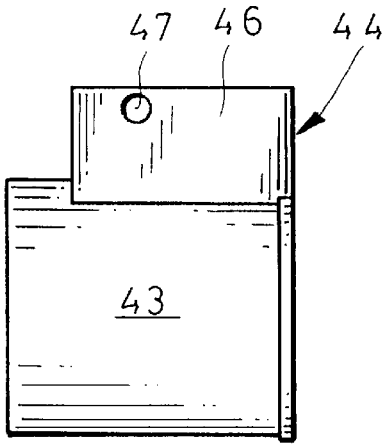
FIGS. 26–30 are various elevational, end, plan and perspective views of the sleeve and locking mechanism housing for the assembly of FIGS. 17–20.
Figure 27:
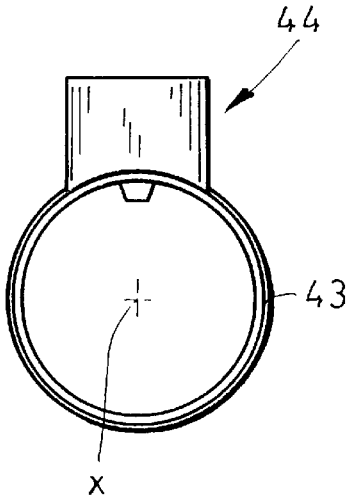
Figure 28:
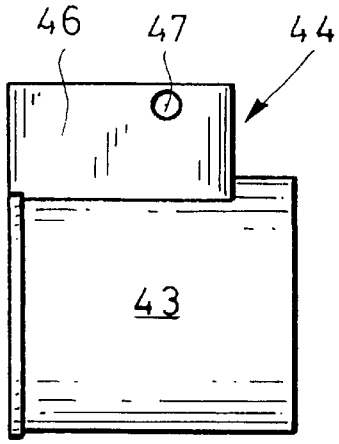
Figure 29:
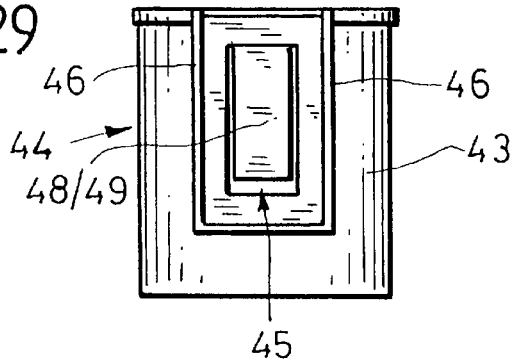
Figure 30:
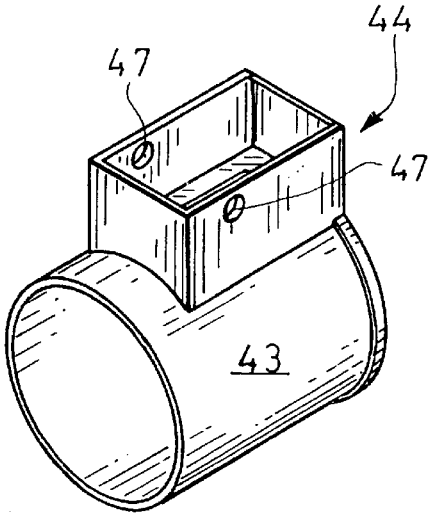
Figure 31:
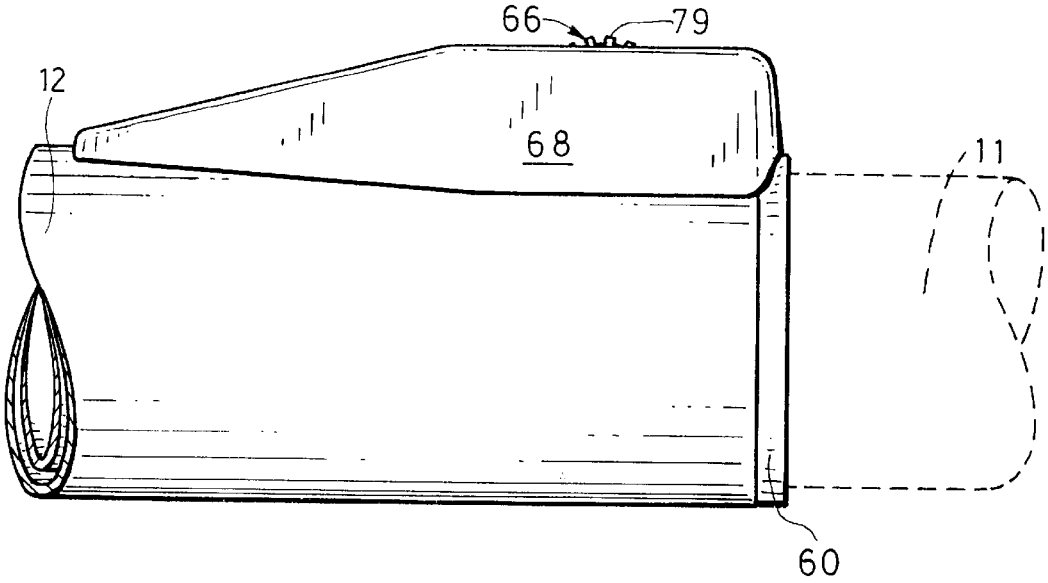

In FIGS. 18–20, in combination with FIG. 29 it can be seen that within the opening 45 of the housing 44 the pawl or pivot arm 48 can be received and that the locking body 49 of the pawl 44 can fit into the recess 14 and relatively snugly within the sleeve 43. The pivotal movement of member 49 can be ensured by providing a film hinge or other transition region between the pawl 48 and the sleeve 43 which permits the movement of the pawl from the locking position shown in FIG. 18 to the unlocked position of FIG. 20. The film hinge or other zone enabling the pivoting movement can be seen at 50 and can be a weakened zone of the material of the housing 44.

FIGS. 21–25 show the rocker 51 in greater detail. The rocker 51 has a bore 52 for the pin or shaft by which the rocker 51 is swingably mounted in the openings 47. The shaft can also be used to engage a jacket or cover (like the cover 68 shown in FIG. 33, if desired).

Below the bore 52, a locking projection 53 is provided on the rocker 51. The rocker also has two rocker arms 54 and 55. The rocker arm 54 has an actuating surface 56 on its upper side and the arm 55 can be dimensioned so that it comes to rest upon a ledge of the housing. A rocker spring 57 is braced between the rocker arm 56 and the housing and can engage over pins on the rocker arm and the housing. FIGS. 18 and 20 show the function of the adjusting device 52 described. In the locking position of FIG. 18, the locking projection 53 with its locking surface 58 bears upon a locking surface 59 of the body 49. The locking spring 57 retains the rocker 51 in the locked position until the rocker arm 56 is manually depressed. The rocker absorbs any radial force on member 49 resulting from the application of axial force to the pipes 11 and 12.

If one applies force in the direction of arrow P by a finger (FIG. 18), the rocker 51 is swung in the clockwise sense to clear member 48 to permit the pawl 48 to swing. In this case the projection 53 is swung out of the path of the body 49 and axial stress between the pipes 11 and 12 allows the flanks of the opening 14 can provide a camming action displacing member 49 out of the recess 14 in the radial direction (see FIG. 20).

FIG. 31–49 illustrate another embodiment which also includes a sleeve 60 and a housing 61 (see especially FIGS. 41–46).

Figure 32:
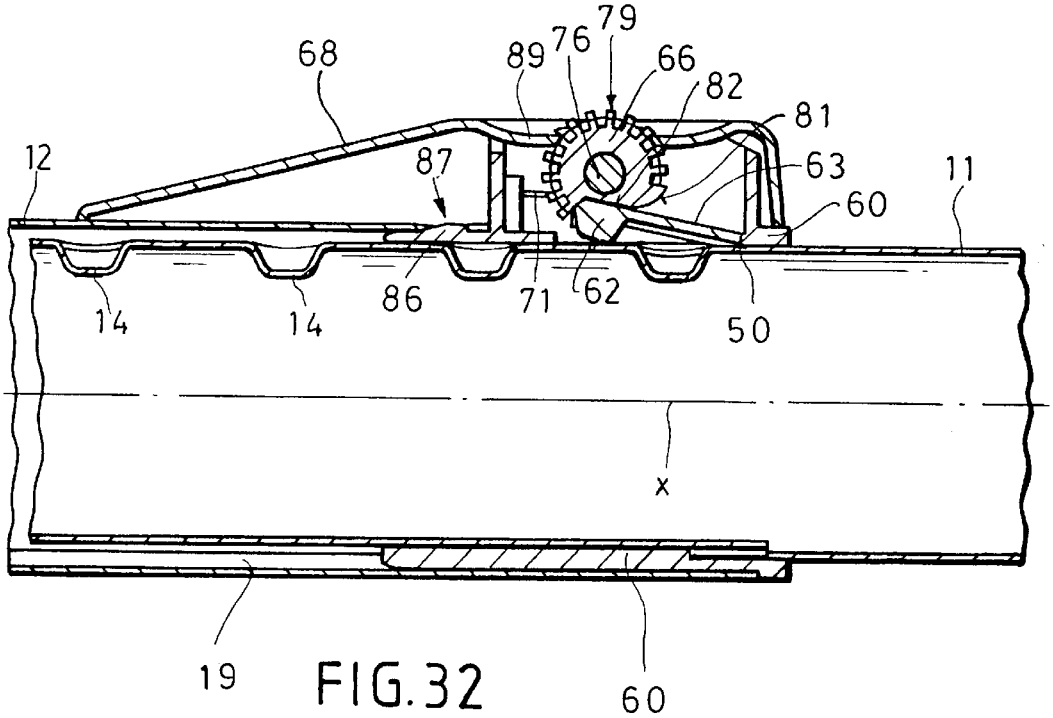
FIG. 32 is a longitudinal section through the assembly of FIG. 31 in the unlocked state thereof.
Figure 44:
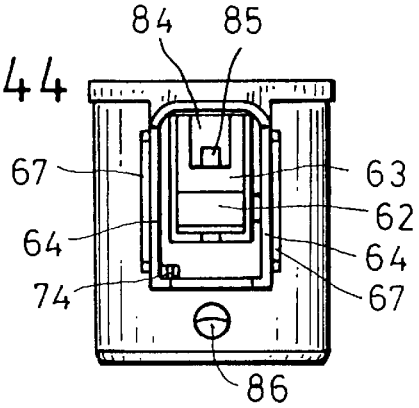
Figure 45:
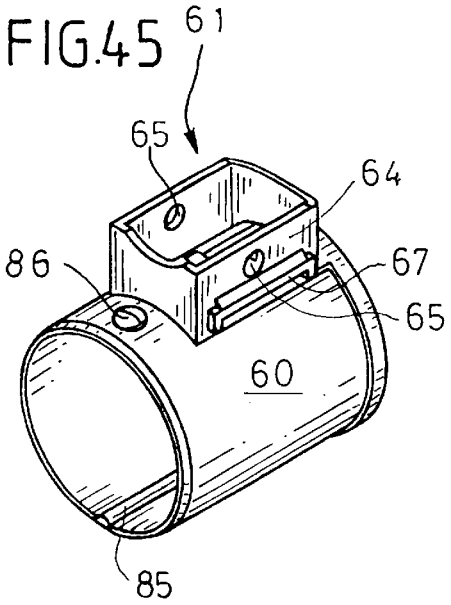
FIGS. 45 and 46 are perspective view of the sleeve and the locking mechanism housing.
Figure 46:
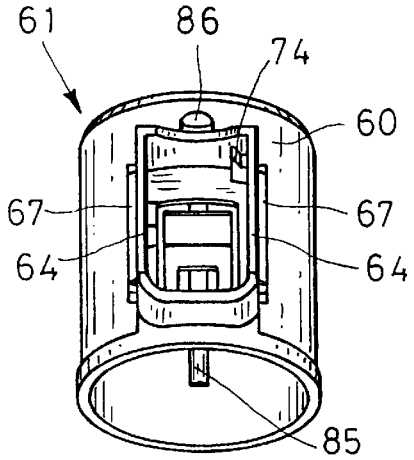
Figure 47:
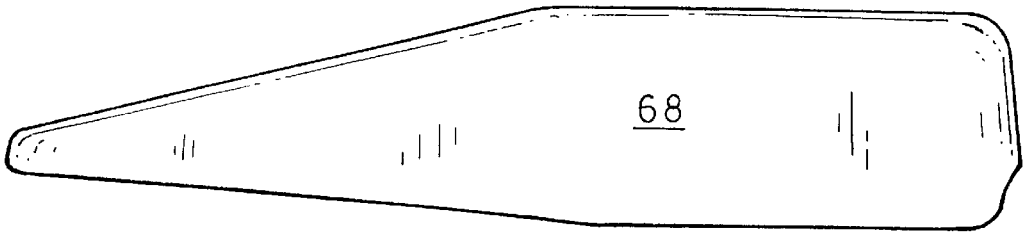
FIGS. 47–49 are views of the cover or jacket for the mechanism of the last-mentioned embodiment.
Figure 48:
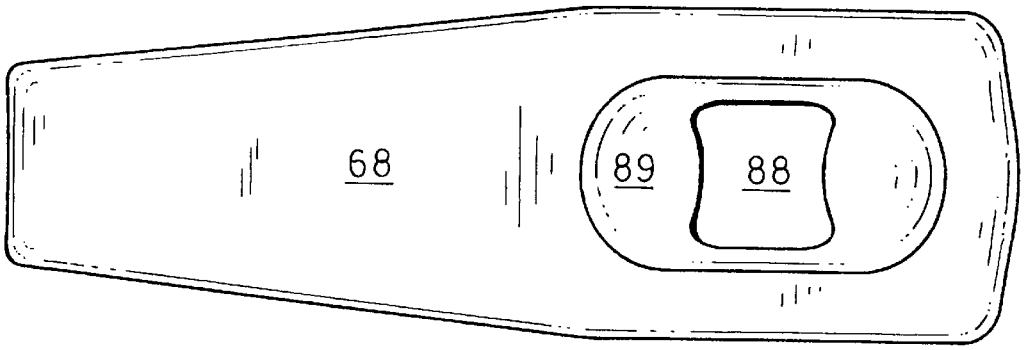

As one can see from FIG. 32 and also from FIG. 44, the sleeve 60 has a locking body 62 which has a pivot arm or pawl 63 connected to the sleeve 60 so that it forms part of that sleeve. For better mobility of the pawl 63, a recess 84 is provided (see FIG. 44). In the aforementioned FIG. 44 below the recess 84 an antirotation device 85 can be seen (see also FIGS. 42 and 44). On the upper surface of the sleeve 60 opposite the housing 61 a rest projection 46 is provided which serves for fastening the sleeve 60 on the outer pipe 12 in a corresponding detent recess 87 (see FIGS. 32 and 33).

In this embodiment as well on the side walls 64 of a housing 61, axial receptors 65 are provided (see FIGS. 41–46) which receive eccentric component 66 visible from FIGS. 37–40. In addition, on the outer side of the side walls 64, detents 67 are formed for engagement with a cover component 68 as is visible in FIGS. 47–49. One can see from FIG. 49 that the covering component 68 has detent means 69 which cooperate with the fastening on the housing with the indexing means there provided.

Figure 49:
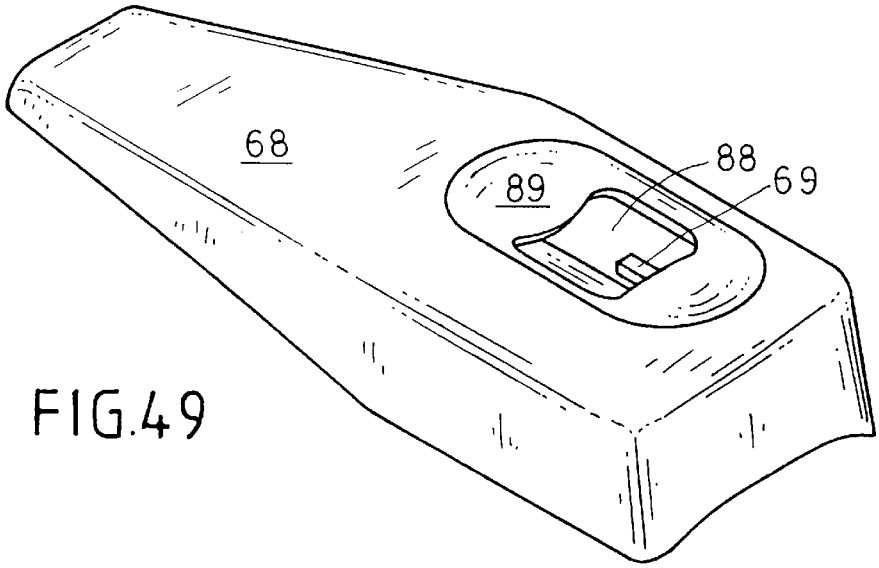

In FIG. 49, only one opening 88 is shown within a recess of the cover component 48. Through this opening 88 extends the eccentric component 66 and is actuatable, because of the recess 89 in a simple manner by a finger.

Figure 33:
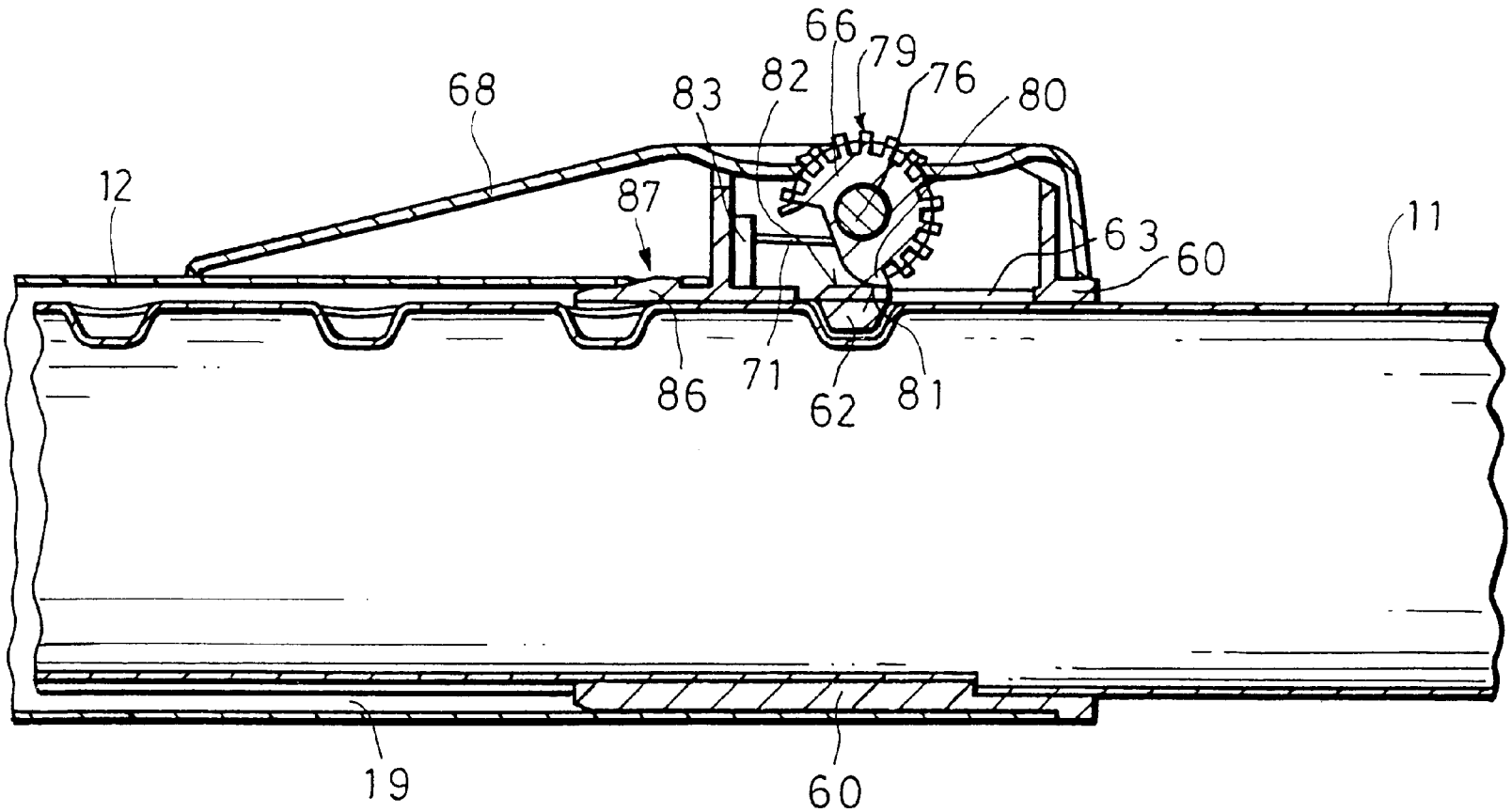
FIG. 33 is a longitudinal section through the assembly of FIGS. 31 and 32 in the locked state.
Figure 34:
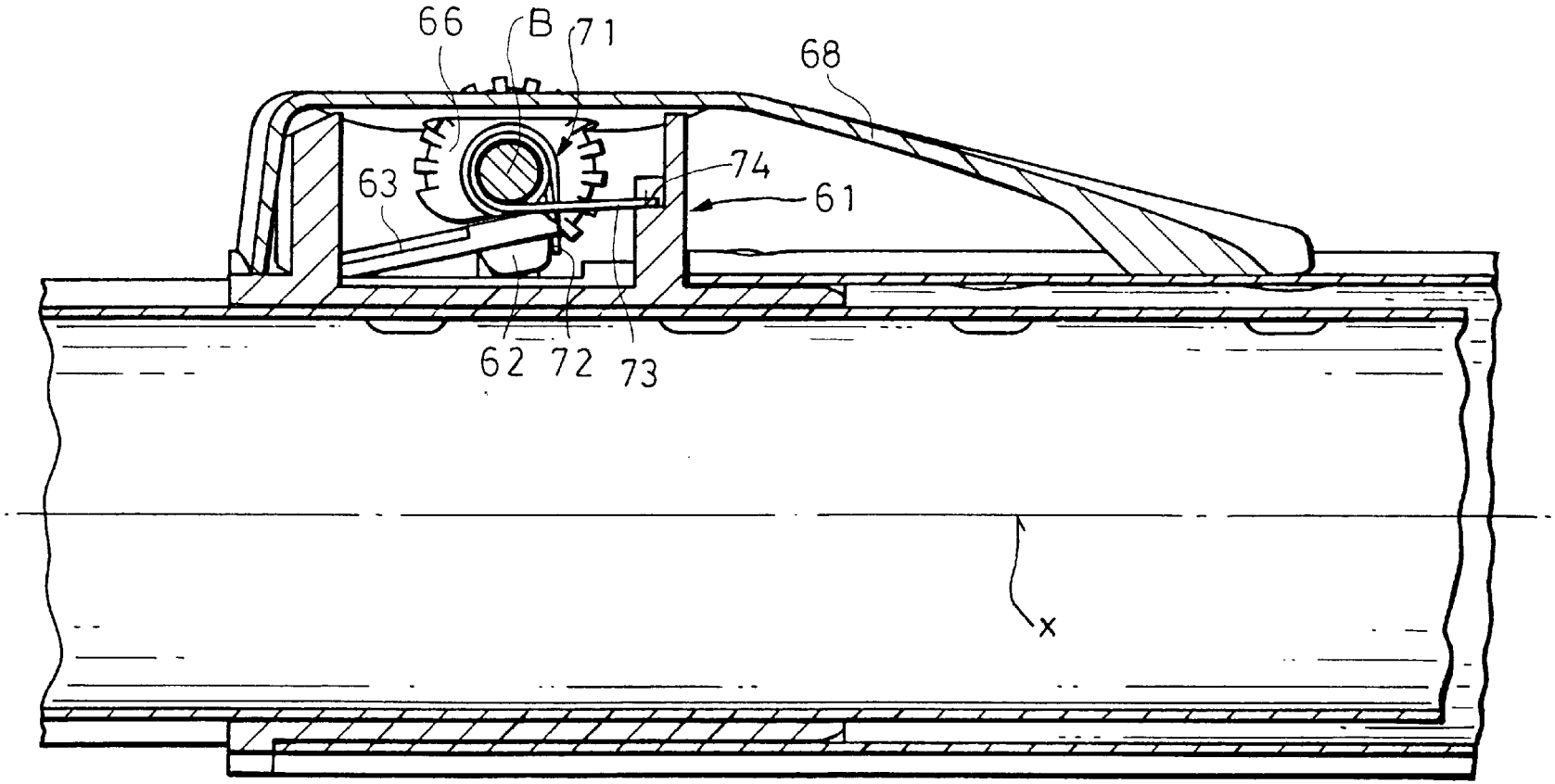
FIGS. 34 and 35 are longitudinal sections of the assembly of FIGS. 31 and 32 in the unlocked state thereof.
Figure 35:
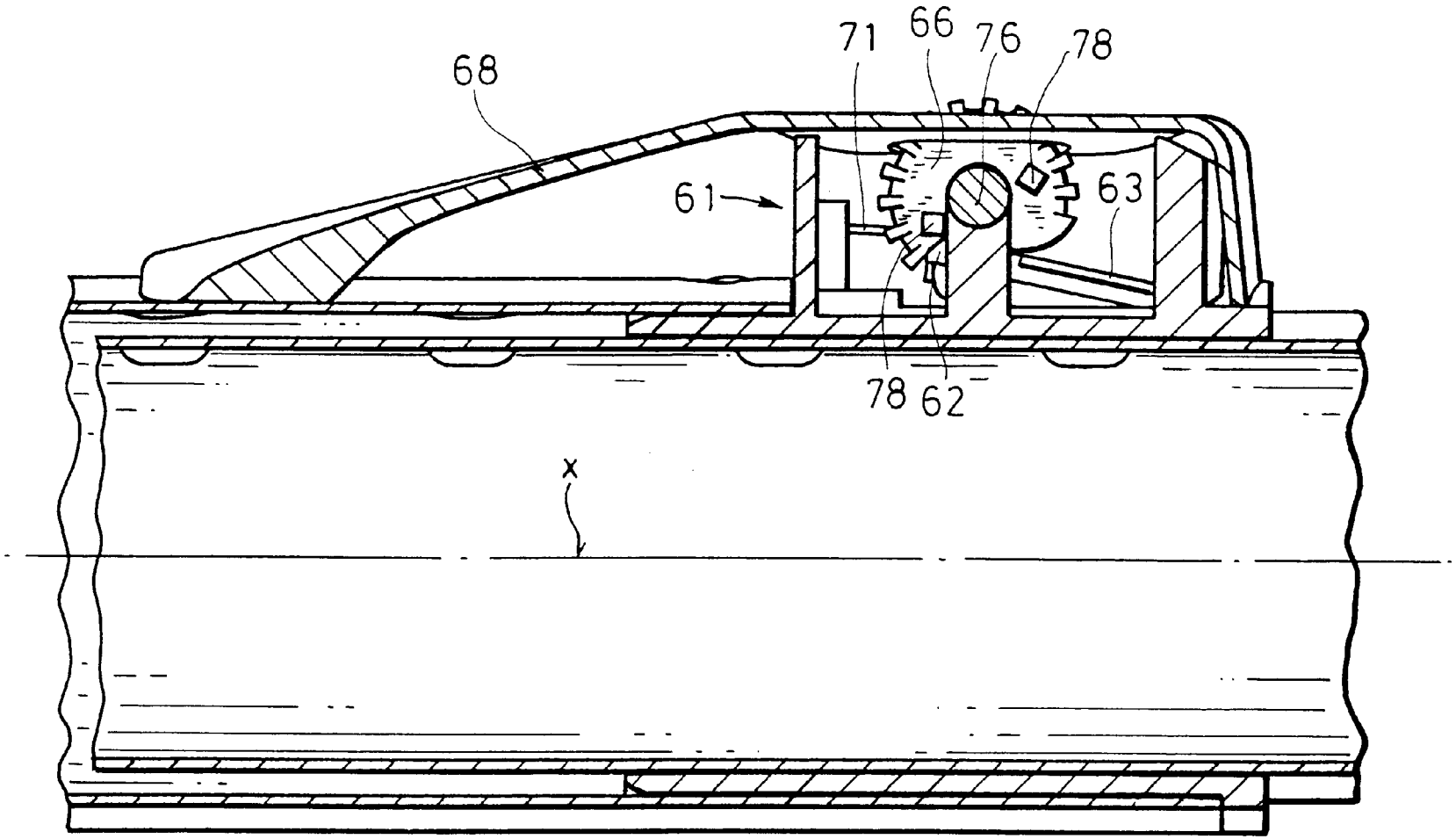

In the housing 61, the eccentric component 66 is rotatable on a pin 76 forming an axis (see FIGS. 32 and 33). The eccentric 66 has a throughgoing bore 70 which receives the pin 76. Once the eccentric 66 is mounted, a spring 71, e.g. a torsion spring, can be so mounted on the pin 76 that a recess 90 of the eccentric 66 is provided to accommodate the shanks of the spring 71 as can be readily seen from FIG. 34. One shank 72 bears against the eccentric 66 and the other shank 73 against an abutment surface 74 of the housing 71. Thus a spring body 75 is provided on the pin 76 of the bore 70 of the eccentric 66.

Finally, a lateral flank 77 of the eccentric component 66 (see FIGS. 35 and 39) with two abutment projections 78 can be provided. The two abutment projections 78 define respective end positions of the eccentric component 66.

Figure 37:
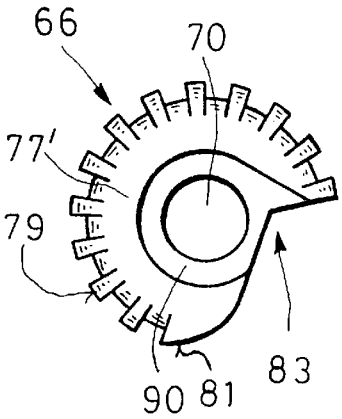
FIGS. 37–40 are end, elevational and perspective views of the eccentric, drawn to a larger scale for the assembly of FIGS. 31 and 32.
Figure 38:
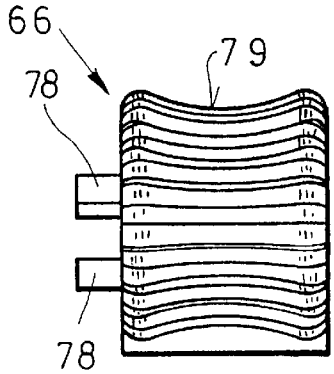
Figure 39:
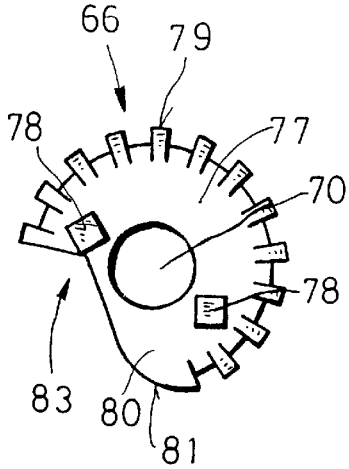
Figure 40:
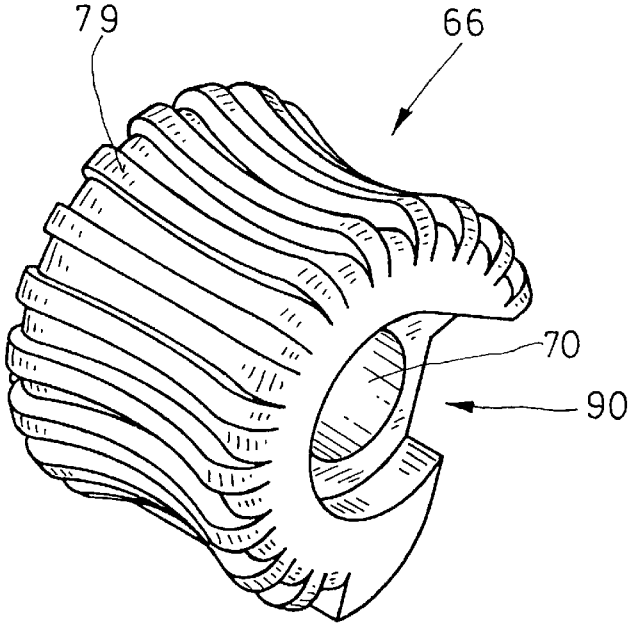
Figure 41:
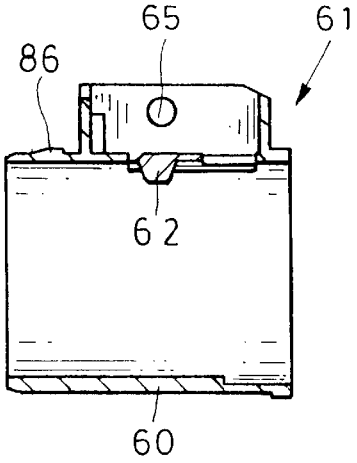
FIGS. 41–44 are cross sectional, end, elevational and plan view of the sleeve and housing for this latter assembly, FIGS. 41 and 43 being respectively taken along the lines XLI—XLI and XLIII—XLIII of FIG. 42.
Figure 42:
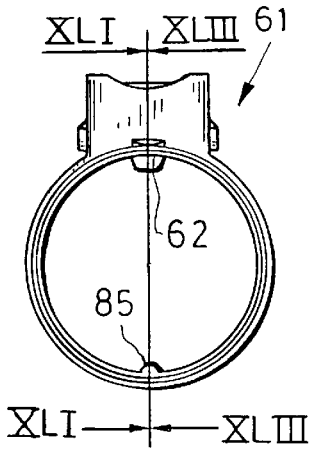
Figure 43:
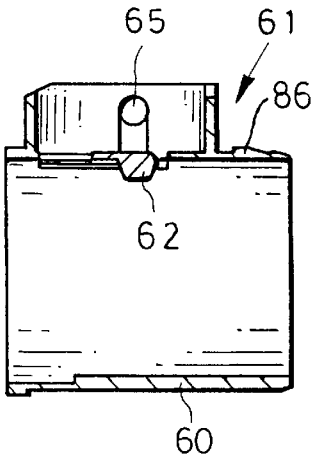

Another lateral surface 77' is provided with the recess 90 in which the spring 71 can be received as has been shown in FIGS. 37 and 40. The surface 79 of the eccentric 66 is milled, ribbed or otherwise provided so that it can be readily rotated by the fingers. The eccentric 66 is so mounted in the housing 61 with the aid of the pin 76 that an eccentric region 80 visible in FIG. 33 acts during the locking position to form the locking surface 81 bearing upon the locking surface 82 of the body 62. In this position of the eccentric 66 the pipes 11 and 12 are firmly locked together and the lock is maintained even under high axial loading. It is important in this connection that the torsion spring 71 be so arranged that the eccentric 66 will automatically be returned into the locking position as defined by the abutment 78.

When the eccentric 66 is rotated in the clockwise sense by the finger of the user until the other abutment 78 is reached, a clearance 83 is provided in the direction of movement of the locking body 62 so that the application of axial force to the pipes 11 and 12 in a sense so as to relatively displace them, will result in outward camming of member 62 (FIG. 32).

In all of the embodiments, in the locking position, the locking surfaces are readily aligned with the rocker or eccentric axis so that radial force cannot induce rotation of the rocker or the eccentric.

We claim:

1. A telescopable vacuum-cleaner suction pipe assembly comprising:

an outer pipe;

an inner pipe telescopingly received in said outer pipe and provided with an axially extending row of detent recesses; and an adjusting mechanism on said outer pipe having:

a sleeve surrounding said inner pipe, a housing on said sleeve opening toward said row, a locking body in said housing displaceable into and out of engagement with a selected one of said detent recesses, an actuator rotatably mounted in said housing and bearing directly upon said body for locking said body in said selected one of said recesses in a locking position of said actuator and enabling movement of said body out of said selected one of said recesses in an unlocked position of said actuator, and a spring acting upon said actuator and biasing said actuator into said locking position, said actuator rotatably mounted in said housing being an actuating and locking rocker having a pair of axially-extending projections received in guide openings in opposite walls of said housing and forming slide blocks shiftable in said opening and pivotal therein.

2. The assembly defined in claim 1 wherein said rocker is provided with a slide surface engageable with an inclined surface of said locking body upon movement of said rocker into said unlocked position.

3. A telescopable vacuum-cleaner suction pipe assembly comprising:

an outer pipe;

an inner pipe telescopingly received in said outer pipe and provided with an axially extending row of detent recesses; and an adjusting mechanism on said outer pipe having:

a sleeve surrounding said inner pipe, a housing on said sleeve opening toward said row, a locking body in said housing displaceable into and out of engagement with a selected one of said detent recesses, an actuator rotatably mounted in said housing and bearing directly upon said body for locking said body in said selected one of said recesses in a locking position of said actuator and enabling movement of said body out of said selected one of said recesses in an unlocked position of said actuator, and a spring acting upon said actuator and biasing said actuator into said locking position, said locking body being swingable on said sleeve.

4. The assembly defined in claim 3 wherein said locking body is formed on a pivot arm connected to and formed from the material of said sleeve.

5. A telescopable vacuum-cleaner suction pipe assembly comprising:

an outer pipe;

an inner pipe telescopingly received in said outer pipe and provided with an axially extending row of detent recesses; and an adjusting mechanism on said outer pipe having:

a sleeve surrounding said inner pipe, a housing on said sleeve opening toward said row, a locking body in said housing displaceable into and out of engagement with a selected one of said detent recesses, an actuator rotatably mounted in said housing and bearing directly upon said body for locking said body in said selected one of said recesses in a locking position of said actuator and enabling movement of said body out of said selected one of said recesses in an unlocked position of said actuator, and a spring acting upon said actuator and biasing said actuator into said locking position, said actuator being an eccentric mounted in said housing for rotation about an axis, said actuator having a surface eccentric to said axis and acting upon said body.

6. The assembly defined in claim 5 wherein said eccentric, upon displacement into said unlocked position provides a clearance into which said body can move.

7. The assembly defined in claim 5 wherein said housing is formed in one piece with said sleeve and said sleeve fills an annular clearance betweens aid outer pipe and said inner pipe.

8. The assembly defined in claim 5 wherein said sleeve is formed in one piece with said housing and surrounds said outer pipe, said outer pipe having an opening through which said body extends into engagement with said one of said detent recesses.

9. A telescopable vacuum-cleaner suction pipe assembly comprising:

an outer pipe;

an inner pipe telescopingly received in said outer pipe and provided with an axially extending row of detent recesses; and an adjusting mechanism on said outer pipe having:

a sleeve surrounding said inner pipe, a housing on said sleeve opening toward said row, a locking body in said housing displaceable into and out of engagement with a selected one of said detent recesses, an actuator rotatably mounted in said housing and bearing directly upon said body for locking said body in said selected one of said recesses in a locking position of said actuator and enabling movement of said body out of said selected one of said recesses in an unlocked position of said actuator, and a spring acting upon said actuator and biasing said actuator into said locking position, said actuator being a rocker forming a cover for the interior of said housing.

10. A telescopable vacuum-cleaner suction pipe assembly comprising:

an outer pipe;

an inner pipe telescopingly received in said outer pipe and provided with an axially extending row of detent recesses; and an adjusting mechanism on said outer pipe having:

a sleeve surrounding said inner pipe, a housing on said sleeve opening toward said row, a locking body in said housing displaceable into and out of engagement with a selected one of said detent recesses, an actuator rotatably mounted in said housing and bearing directly upon said body for locking said body in said selected one of said recesses in a locking position of said actuator and enabling movement of said body out of said selected one of said recesses in an unlocked position of said actuator, and a spring acting upon said actuator and biasing said actuator into said locking position, wherein said actuator being a rotatable eccentric, said outer pipe having a cover enclosing said sleeve and said housing and formed with an opening through which said eccentric extends.

* * * * *